US006109732A

United States Patent [19]

Wen

[11] Patent Number: 6,109,732

[45] Date of Patent: Aug. 29, 2000

[54] IMAGING APPARATUS AND METHOD ADAPTED TO CONTROL INK DROPLET VOLUME AND VOID FORMATION

[75] Inventor: Xin Wen, Rochester, N.Y.

[73] Assignee: Eastman Kodak Company, Rochester, N.Y.

[21] Appl. No.: 09/326,351

[22] Filed: Jun. 4, 1999

Related U.S. Application Data

[63] Continuation-in-part of application No. 08/826,357, Mar. 26, 1997, which is a continuation-in-part of application No. 08/783,256, Jan. 14, 1997, which is a continuation-in-part of application No. 08/826,353, Mar. 26, 1997.

[51] Int. Cl.[7] ..... B41J 2/05; B41J 2/205

[52] U.S. Cl. ..... 347/57; 347/15

[58] Field of Search ..... 347/10, 11, 7, 347/56, 57, 46, 61, 14, 19, 15

[56] References Cited

U.S. PATENT DOCUMENTS

| | | | |
|---|---|---|---|
| 4,463,359 | 7/1984 | Ayata et al. | 347/56 |
| 4,513,299 | 4/1985 | Lee et al. | 347/15 |
| 4,563,689 | 1/1986 | Murakami et al. . | |
| 4,686,539 | 8/1987 | Schmidle et al. | 347/15 |
| 5,124,716 | 6/1992 | Roy et al. | 347/15 |
| 5,202,659 | 4/1993 | Debonte et al. | 347/15 |
| 5,495,270 | 2/1996 | Burr et al. | 347/10 |
| 5,557,304 | 9/1996 | Stortz | 347/15 |
| 5,657,060 | 8/1997 | Sekiya et al. | 347/15 |
| 5,864,351 | 1/1999 | Silverbrook | 347/11 |

FOREIGN PATENT DOCUMENTS

| | | |
|---|---|---|
| 0 288 044 A2 | 10/1988 | European Pat. Off. . |
| 0 609 997 A2 | 8/1994 | European Pat. Off. . |
| 0 649 746 A1 | 4/1995 | European Pat. Off. . |
| 0 709 213 A1 | 5/1996 | European Pat. Off. . |
| 58-011169 | 1/1983 | Japan . |
| 05238010 | 9/1993 | Japan . |
| WO 96/32289 | 10/1996 | WIPO . |

OTHER PUBLICATIONS

U.S. Pat. Application Ser. No. 08/783,256 titled "Ink Jet Printhead For Multi–Level Printing" filed Jan. 14, 1997 by Xin Wen.

*Primary Examiner*—John Barlow
*Assistant Examiner*—Juanita Stephens
*Attorney, Agent, or Firm*—Walter S. Stevens

[57] ABSTRACT

Imaging apparatus and method adapted to control ink droplet volume and void formation. The apparatus includes an ink jet print head having a nozzle for ejecting an ink droplet therefrom. A heater element is in heat transfer communication with the ink droplet for variably supplying heat energy to the ink droplet, so that the volume of the ink droplet is controlled as the heat energy is variably supplied to the ink droplet. A controller is connected to the heater element for variably controlling the heat energy supplied to the ink droplet. The controller variably controls the heat energy by variably controlling a plurality of voltage pulses sequentially supplied to the heater element. Moreover, in order to reduce the potential for void formation in the ink droplet, the pulses are spaced-apart by a predetermined delay interval. Suitable control of ink droplet volume and delay interval between pulses results in uniform print density and "gray-scaling" of each dot or pixel in the output image and also precludes void formation.

34 Claims, 10 Drawing Sheets

145
TIME
$T_{MAX}$
VOLTAGE

145
TIME
$M_1$ $M_2$ $M_3$ $M_4$ $M_5$ $M_6$
$M_i$
$M_{i-2}$ $M_{i-1}$ $M$
VOLTAGE

145
TIME
PULSE
$Q_1$ $Q_2$ $Q_3$ $Q_4$
$Q_i$
$Q_{i-2}$ $Q_{i-1}$ $Q$
VOLTAGE

IMAGING APPARATUS AND METHOD ADAPTED TO CONTROL INK DROPLET VOLUME AND VOID FORMATION

CROSS REFERENCE TO RELATED APPLICATIONS

The instant application is a continuation-in-part of commonly assigned, copending U.S. patent application Ser. No. 08/826,357 titled "Imaging Apparatus And Method Adapted To Control Ink Droplet Volume And Void Formation" filed Mar. 26, 1997 in the name of Xin Wen. Reference is also made to commonly assigned, which is a CIP of copending U.S. patent application Ser. No.08/783,256 titled "Ink Jet Printhead For Multi-Level Printing" filed Jan. 14, 1997 which is a CIP of commonly assigned, copending U.S. patent application Ser. No. 08/826,353 (attorney docket no. 75069) titled "Imaging Apparatus And Method For Providing Images Of Uniform Print Density" filed Mar. 26, 1997, both in the name of Xin Wen.

FIELD OF THE INVENTION

The present invention relates generally to imaging apparatus and methods and, more particularly, to an imaging apparatus and method adapted to control ink droplet volume, so that printing non-uniformities, such as "banding", are avoided and so that print density can be controllably varied to provide gray-scaling at each dot or pixel of an output image, the imaging apparatus and method being also adapted to inhibit the potential for void formation in the ink.

BACKGROUND OF THE INVENTION

In a typical ink jet printer using a multi-nozzle head, data as to each of four colors (i.e., red, green, blue and black) regarding an input image are processed in a manner so that the multi-nozzle head forms a printed color output image on a recorder medium, which may be a suitable paper or transparency.

However, ink jet printers may produce non-uniform print density with respect to the image formed on the recorder medium. Such non-uniform print density may be visible as so-called "banding". Banding is evinced, for example, by repeated variations in the print density caused by delineations in individual dot rows comprising the output image. Thus, banding can appear as light or dark streaks or lines within a printed area. One factor causing banding is unintended variation in ink droplet volume. Unintended variation in ink droplet volume in turn may be caused by electrical resistance variation of a plurality of heaters in communication with the ink droplet, nozzle diameter variation, and/or the presence of damaged nozzles. Therefore, a problem in the art is non-uniform print density due to variation in nozzle physical attributes which in turn leads to variation in ink droplet volume.

Moreover, the ability of some prior art ink jet printers to produce halftone images has been limited because the ink jet print heads belonging to such printers produce ink droplets having a fixed volume. Marks produced by such droplets are of a fixed size and the same intensity. Consequently, these ink jet print heads utilize spot density, rather than spot size, to produce a gray-scale image. That is, these ink jet print heads produce various shades of gray by varying the density of the fixed size ink marks such that darker shades are produced by increasing spot density and lighter shades are produced by reducing spot density. However, such printers have reduced spatial resolution, thereby limiting the ability of the ink jet printer to produce finely detailed images. Spatial resolution is reduced because varying frequency of the constant spot size in a printed area obtains lower resolution when compared to keeping a constant frequency but varying the spot size. Moreover, directing multiple droplets at a single location of the recorder medium to increase spot size tends to reduce the operating speed of the printer to an unacceptably low level and may even produce elongated or elliptical dot patterns. Therefore, another problem in the art is difficulty producing ink droplets that vary in size.

An ink jet printer device directed to controlling ink droplet volume and gray-scaling is disclosed in U.S. Pat. No. 4,563,689 titled "Method For Ink-Jet Recording And Apparatus Therefor". This patent discloses an ink jet recording apparatus and process in which the droplet size is controlled to obtain halftone-graduation recording. According to this patent, a preceding pulse is applied to an electromechanical transducer prior to applying a main pulse so as to control the position of the ink meniscus in the nozzle and thereby control droplet size.

However, this patent requires use of an electromechanical transducer to control ink droplet size. Use of an electromechanical transducer is not preferred because electromechanical transducers are difficult and costly to fabricate due to their structural complexity.

Another type of ink jet printer which addresses the afore mentioned problems of controlling ink drop volume and gray-scaling is disclosed in U.S. patent application Ser. No. 08/783,256 titled "Ink Jet Printhead For Multi-Level Printing". In this device, a recorder medium is reciprocatingly moved adjacent a plurality of nozzles in order to sequentially apply four colors of an input image onto the recorder medium. To achieve this result, an ink droplet in each nozzle is under a predetermined static back-pressure in order to propel the ink droplet toward the recorder medium. However, before the ink droplet is propelled toward the recorder medium, it is initially restrained or held in the orifice by surface tension even though the ink droplet is under static back-pressure. This results in an ink meniscus bulging outwardly at the nozzle orifice without leaving the orifice. This is so because, by design, the back-pressure is initially insufficient to overcome the ink droplet's surface tension. Therefore, in order to print on the recorder medium, the surface tension of the ink droplet is controllably decreased, so that the ink droplet is released from the nozzle orifice at the desired time and propelled onto the recorder medium by the previously mentioned static back-pressure. To decrease surface tension, a voltage pulse is applied to an electrical resistance heater that is in heat transfer communication with the ink droplet. Heating of the resistance heater by the voltage pulse heats the ink droplet, thereby reducing the surface tension of the ink droplet. Of course, the static back-pressure acting on the ink droplet coacts with the simultaneous decrease in surface tension to eject the ink droplet from the orifice and propel it toward the recorder medium. Means are provided to obtain uniform print density by controlling the heat energy supplied to the ink droplet. However, potential for heating of the ink in this type of ink jet printer can at least theoretically, lead to boiling and void formation in the ink. Void formation is the formation of bubbles (i.e., voids) in the ink. Void formation is undesirable because the bubbles resulting from void formation could coalesce and block the nozzle orifice. Blocking the nozzle orifice interferes with proper ejection of the ink from the nozzle, thus leading to undesirable printing defects in the output image. Although this printer addresses the problem of banding, it does not expressly address the potential for void formation. Therefore, yet another problem in the art is the potential for void formation caused by excessive heating of the ink.

Therefore, what has long been needed is an imaging apparatus and method adapted to control ink droplet volume, so that printing of anomalous non-uniformities, such as "banding", are avoided and so that print density can be controllably varied to provide gray-scaling at each dot or pixel and so that the potential for void formation in the ink is reduced.

SUMMARY OF THE INVENTION

The invention in its broad form resides in an imaging apparatus, comprising a nozzle for ejecting print fluid therefrom, the print fluid having a volume defined by heat energy supplied to the print fluid and having a potential for void formation; a heater adapted to be in heat transfer communication with the print fluid for supplying the heat energy to the print fluid; and a controller connected to the heater for variably controlling a plurality of voltage pulses supplied to the heater in order to variably control the heat energy supplied by the heater, whereby the volume of the print fluid ejected from the nozzle is variably controlled as the controller variably controls the heat energy and whereby the potential for void formation in the print fluid is reduced as the controller variably controls the heat energy.

An object of the present invention is to provide a suitable imaging apparatus and method for obtaining images of uniform print density produced by print nozzles, so that printing of non-uniformities, such as banding, are avoided, even when the print nozzles have different physical attributes normally resulting in non-uniform printing.

Another object of the present invention is to provide a suitable imaging apparatus and method capable of controllably varying print density at each dot or pixel forming the printed image without use of an electromechanical transducer.

A further object of the present invention is to provide a suitable imaging apparatus and method capable of reducing the potential for void formation in the ink.

A feature of the present invention is the provision of a plurality of heater elements associated with respective ones of the nozzles, each heater element being in heat transfer communication with print fluid in the nozzle for heating the print fluid.

Another feature of the present invention is the provision of a controller connected to the heater elements for supplying a plurality of voltage pulses to each of the heater elements, the pulses having a predetermined pulse amplitude and a predetermined pulse width to control the volume of print fluid released from the nozzle, the pulses being separated by a predetermined delay interval in order to reduce the potential for void formation in the print fluid.

Still another feature of the present invention is the provision of a memory unit connected to the controller for storing values of print density as a function of ink droplet volume for each nozzle, the memory unit capable of informing the controller of the correct ink droplet volume required from each nozzle in order to obtain a uniform print density for the output image and to obtain a desired gray-scale level at each dot or pixel.

Yet another feature of the present invention is the provision of a memory unit connected to the controller for storing values of ink droplet volume as a function of voltage pulse amplitude and voltage pulse width supplied to each nozzle, the memory unit capable of informing the controller of the pulse amplitude and pulse width to be supplied to each nozzle in order to obtain a desired ink droplet volume from each nozzle.

An advantage of the present invention is that use thereof eliminates visual printing defects, such as "banding", even in the presence of variations in such physical attributes as electrical resistance of the heater, and/or variation in the diameter of the nozzle orifice, and/or the presence of damaged nozzles.

Another advantage of the present invention is that use thereof provides for multi-density scales (i.e., gray-scaling) at each dot or pixel location without use of an electromechanical transducer.

A further advantage of the present invention is that use thereof reduces the potential for void formation in the ink to be ejected from the nozzle.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

Figure 1:
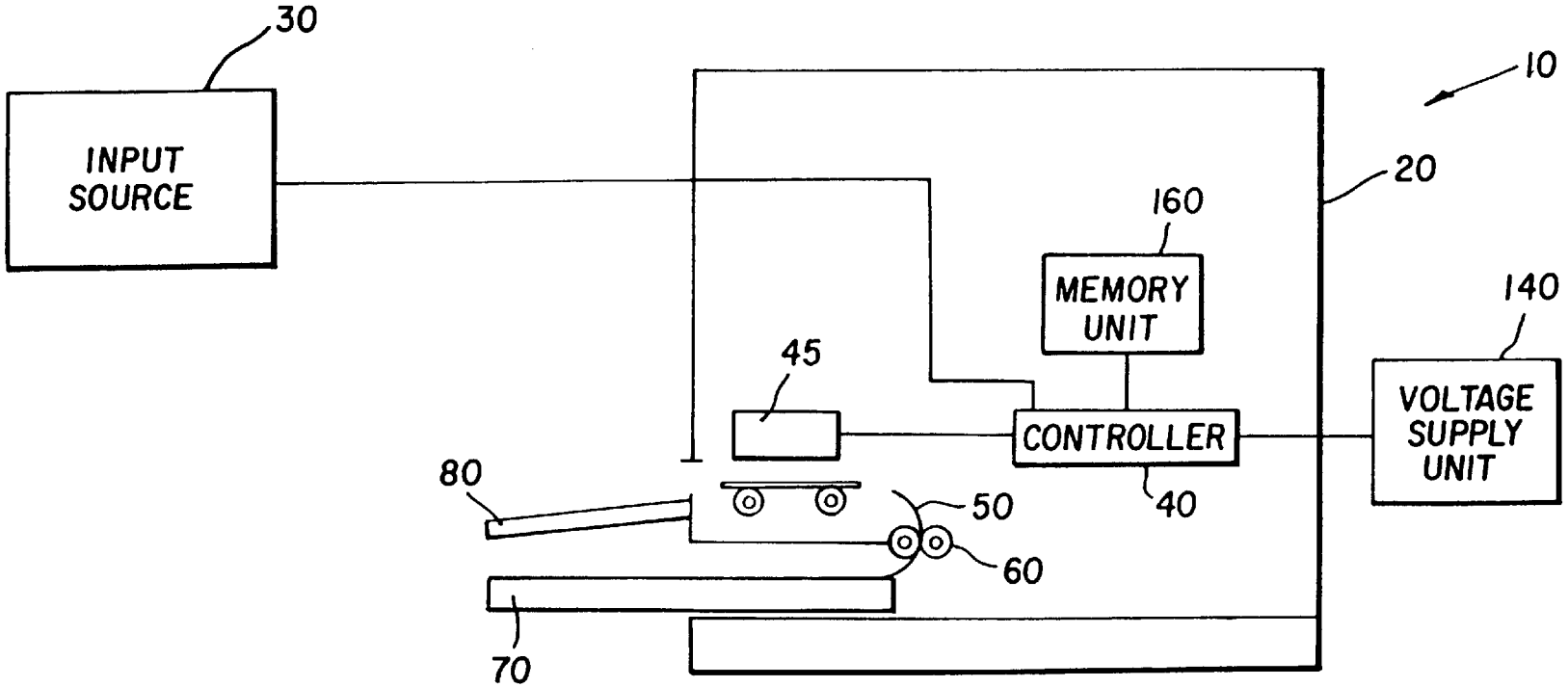
FIG. 1 is a view in partial vertical section, with parts removed for clarity, of an imaging apparatus, this view showing an ink-jet print head for printing an image onto a recorder medium, this view also showing a controller connected to the print head for controlling volume of ink droplets ejected from the print head and for controlling the delay interval between a plurality of voltage pulses supplied to the print head.

Referring to FIG. 1, there is shown an imaging apparatus, generally referred to as 10, capable of varying ink droplet volume at each pixel of an output image, capable of producing the output image so that the output image lacks printing defects such as "banding", and capable of reducing the potential for void formation in the ink droplet. Imaging apparatus 10 comprises a printer, generally referred to as 20, electrically connected to an input source 30 for reasons disclosed hereinbelow. Input source 30 may provide raster image data from a scanner or computer, outline image data in the form of a page description language, or other form of digital image data. The output signal generated by input source 30 is received by a controller 40, for reasons disclosed in detail hereinbelow.

Figure 2:
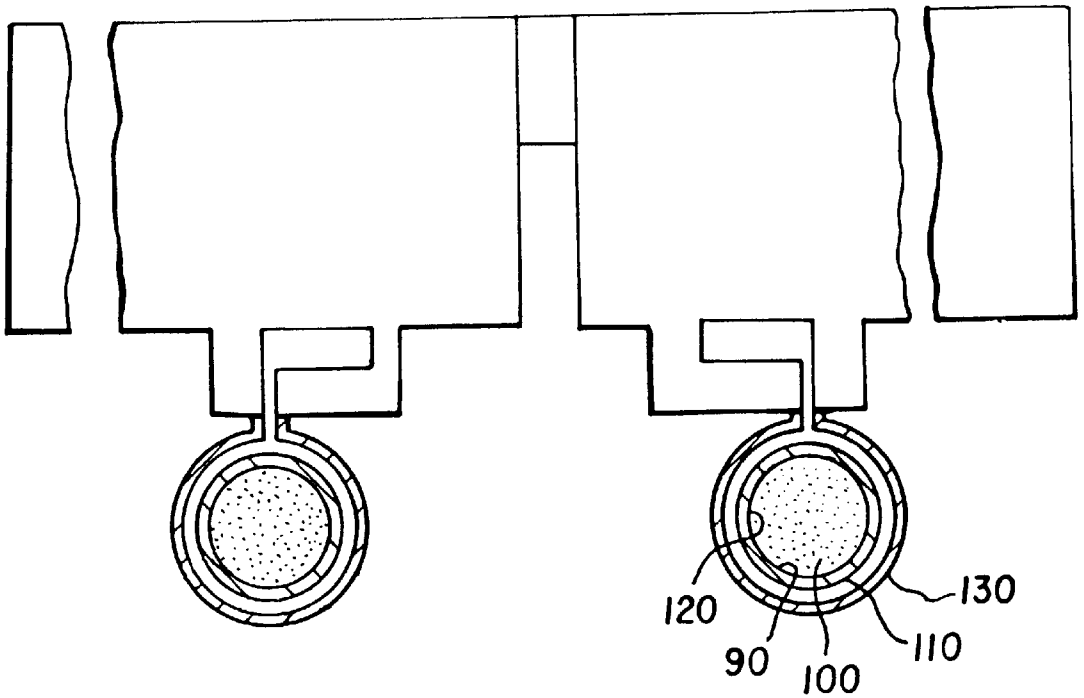
FIG. 2 is a view in horizontal section of a portion of the print head, this view also showing a plurality of nozzles and associated cavities filled with ink, each of the nozzles hating an electric resistance heater in heat transfer communication with the ink therein.
Figure 3:
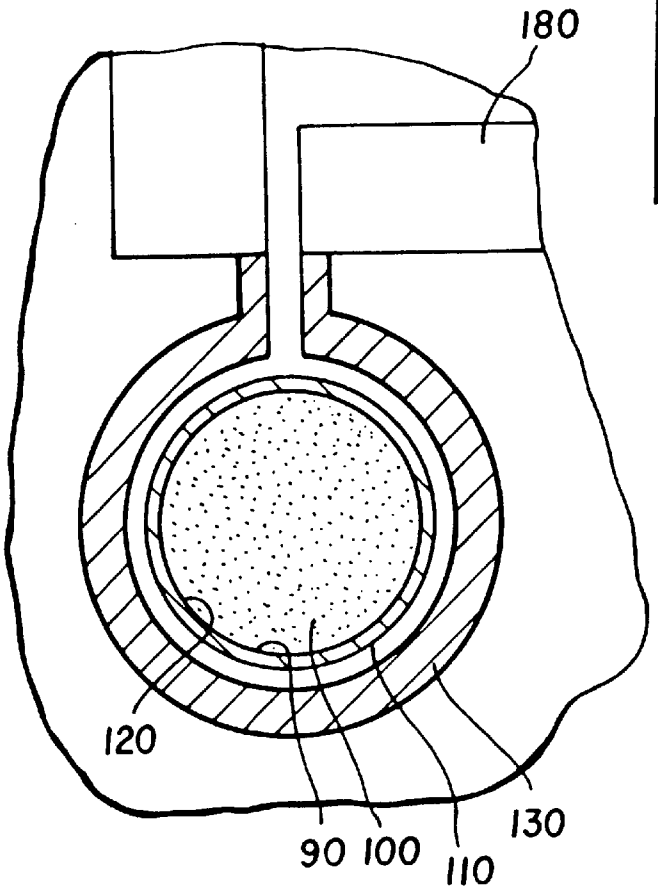
FIG. 3 is a detail view in horizontal section of one of the nozzles.

Referring to FIGS. 1 and 2, controller 40 processes the output signal generated by input source 30 and generates a controller output signal that is received by a print head 45 which is capable of printing on a recorder medium 50. Recorder medium 50 is reciprocatingly fed past print head 45 at a predetermined feed rate by a plurality of rollers 60 (only some of which are shown). More specifically, recorder medium 50 is reciprocatingly moved adjacent print head 45 in order to sequentially apply four colors (i.e., red, green, blue and black) of an input image file onto recorder medium 50. Recorder medium 50 is fed, by rollers 60, from an input supply tray 70 containing a supply of recorder medium 50. Each line of image information from input source 30 is printed on recorder medium 50 as that line of image information is communicated from input source 30 to controller 40. Controller 40 in turn communicates that line of image information to print head 45 as recorder medium 50 moves relative to print head 45. When a completely printed image is formed on recorder medium 50, recorder medium 50 exits the interior of printer 20 to be deposited in an output tray 80 for retrieval by an operator of imaging apparatus 10. Although the terminology referring to "print head 45" is used in the singular, it is appreciated by a person of ordinary skill in the art that the terminology "print head 45" is intended also to include its plural form because there may be, for example, four print heads 45, each of the print heads 45 being respectively dedicated to printing one of the previously mentioned four colors (i.e., red, green, blue and black).

Turning now to FIGS. 1, 2, 3, and 4, print head 45, which belongs to printer 20, is there shown in operative condition for printing an image on recorder medium 50. Print head 45 comprises a plurality of ink fluid cavities 90 for holding print fluid, such as a body of ink 100. Moreover, associated with each cavity 90 is a nozzle 110 for allowing ink 100 to exit cavity 90 under a suitable back pressure (e.g., 15 psi). In this regard, each nozzle 110 includes a generally circular orifice 120 in fluid communication with ink 100. Orifice 120, which is disposed proximate recorder medium 50, opens toward recorder medium 50 for depositing ink 100 onto recorder medium 50. Moreover, surrounding orifice 120 is a generally annular electrothermal actuator (i.e., an electrical resistance heater element) 130 for heating ink 100. Thus, each heater 130 is in heat transfer communication with ink 100. A voltage supply unit 140 is electrically connected to print head 45 (via controller 40) for supplying a plurality of controlled voltage pulses 145 to each heater 130, for reasons disclosed in detail hereinbelow. Controller 40 controls the pulse amplitude, pulse width and delay interval between voltage pulses so that ink droplet volume at each nozzle 110 is controlled in order to control print density produced by each nozzle 110 and so that the potential for void formation in ink body 100 is reduced as ink body 100 is heated. Controlling print density at each nozzle 110 allows "gray scale" printing at each nozzle 110 and eliminates undesirable "banding", as described more fully hereinbelow. Moreover, controlling the potential for void formation in ink body 100 reduces risk of blocking orifice 120 by coalescence of bubbles thereat.

Figure 5:
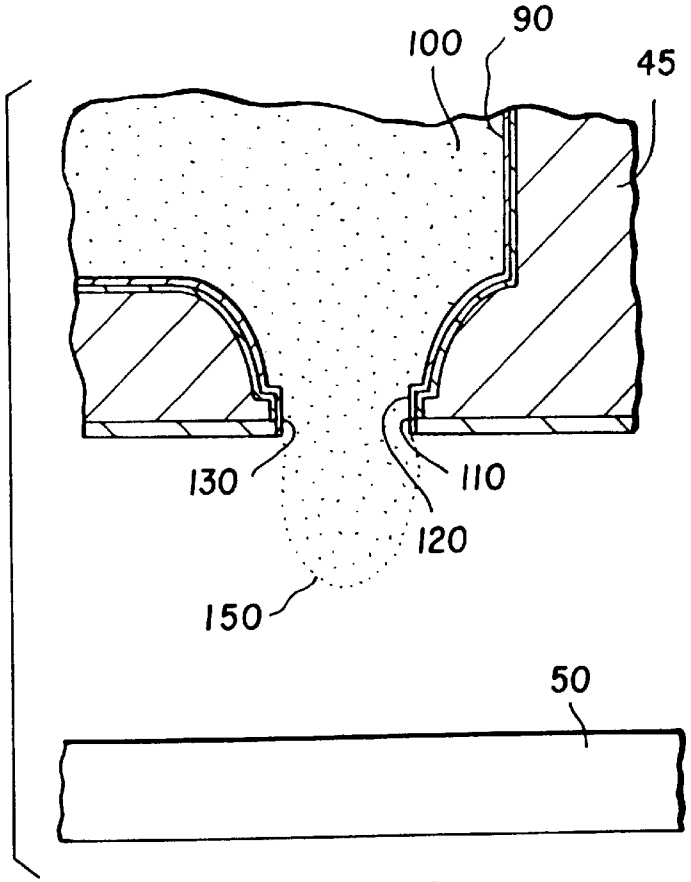
FIG. 5 is a view in vertical section of the nozzle showing an ink droplet emerging from the nozzle as the surface tension begins to relax.
Figure 4:
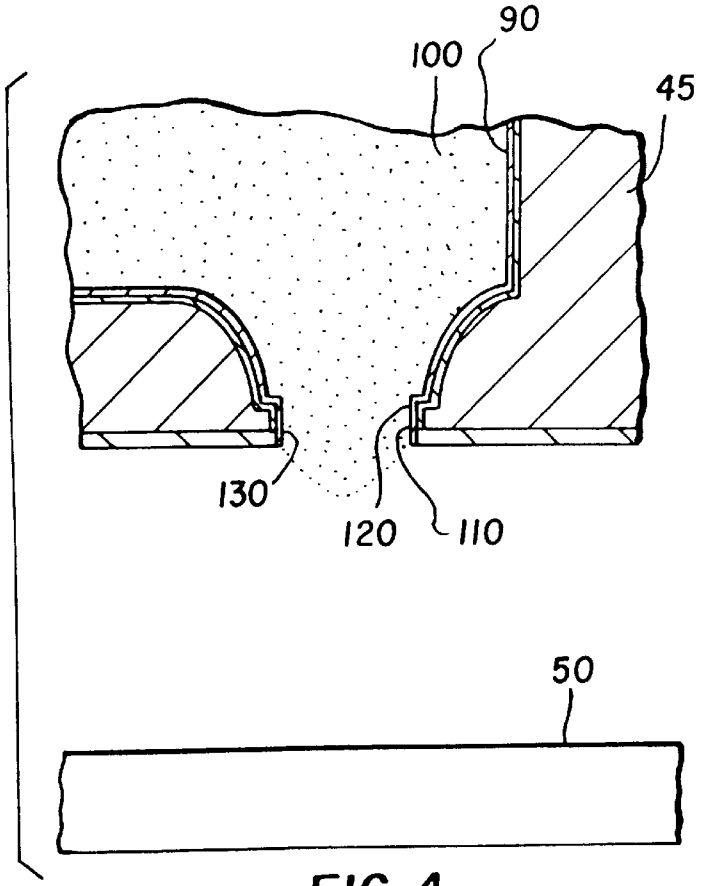
FIG. 4 is a view in vertical section of the nozzle showing the ink being restrained by surface tension from emerging from the nozzle.
Figure 6:
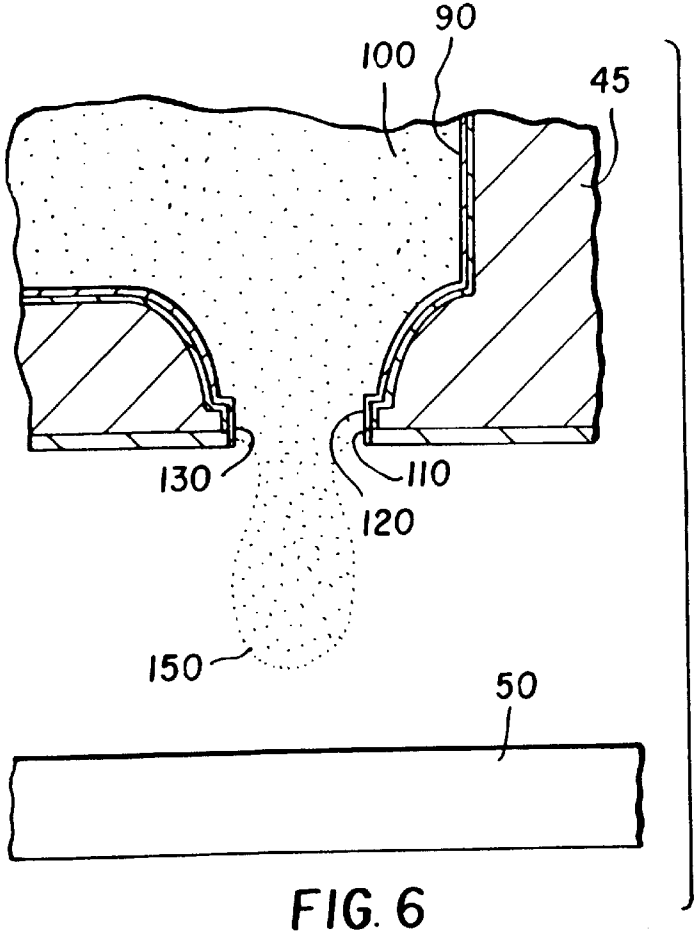
FIG. 6 is a view in vertical section of the nozzle showing the ink droplet emerging further from the nozzle as the surface tension further relaxes.

As best seen in FIGS. 5 and 6, an ink bulge, meniscus or droplet 150 outwardly emerges from orifice 120 as resistance heater 130 increases temperature in order to heat droplet 150. This heating of droplet 150 results in a localized decrease in surface tension of droplet 150, so that droplet 150 is eventually released from orifice 120 when the surface tension becomes insufficient to overcome the back-pressure acting on droplet 150.

Figure 7:
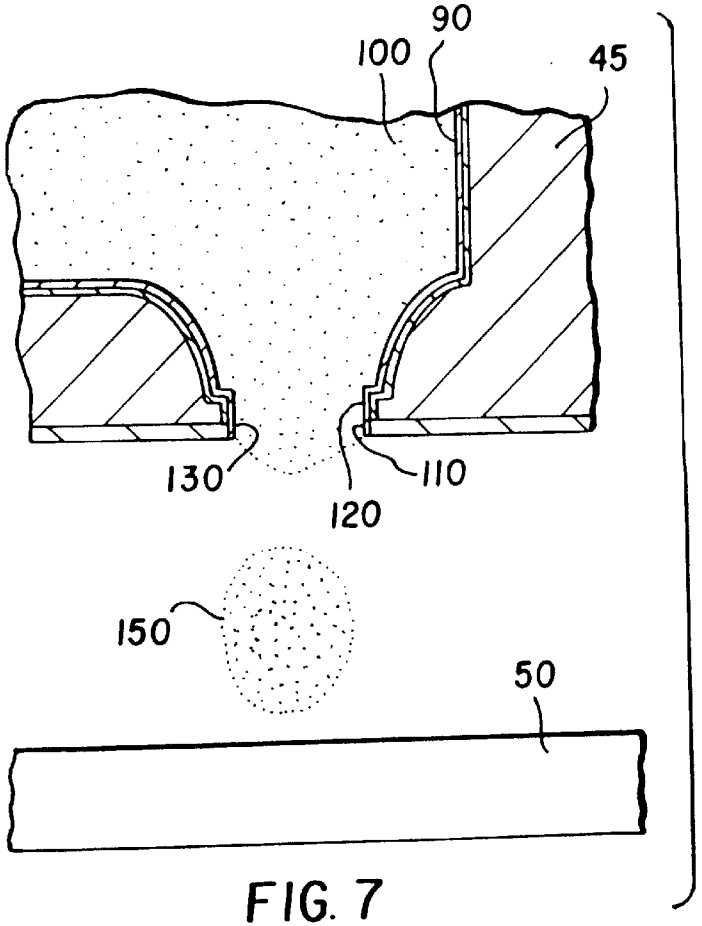
FIG. 7 is a view in vertical section of the nozzle showing the ink droplet having emerged from the nozzle and propelled toward the recorder medium by back-pressure.

FIG. 7 shows droplet 150 separated from ink body 100 and ejected from orifice 120 as it is propelled outwardly toward recorder medium 50 to establish an ink mark upon recorder medium 50. Droplet 150 eventually will be intercepted by recorder medium 50 to "soak into" and be absorbed by recorder medium 50. Of course, the image printed onto recorder medium 50 should possess a uniform print density to avoid banding and should produce an appropriate gray-scale at each dot or pixel of the image. In addition, the amount of heat energy supplied to ink body 100 by heater 130 should not be in an amount to cause void formation in ink body 100.

However, it is known that "banding" (i.e., print density non-uniformity) is a recurring problem in the printing arts. Banding is usually caused by variability in the diameter of orifice 120 or by variability in electrical resistance among resistance heaters 130. Even small variations in diameter and electrical resistance can lead to visible "banding".

Moreover, it is known that some prior art ink jet printers have difficulty producing gray-scale images because the prior art ink jet print heads belonging to such printers produce ink droplets having a fixed volume. Consequently, such printers produce shades of gray by varying the density of the fixed size of the ink droplet. However, images provided by this method lack fine detail due to reduced spatial resolution.

In addition, it is known that excessive heating of ink body 100 or excessive heat energy input to ink body 100 raises at least the potential for boiling or void formation in ink body 100. Void formation in ink body 100 is undesirable because the bubbles resulting from void formation may coalesce and block orifice 120, thereby interfering with proper ejection of ink from orifice 120. Interference with ejection of ink from orifice 120 produces defects in the output image printed on recorder medium 50.

To solve the problems recited hereinabove, the present invention supplies a plurality or series of voltage pulses to each heater 130 and controls the pulse amplitude, pulse width and delay interval between pulses. Controlling these control parameters compensate for physical anomalies (e.g., variations in the diameter of orifice 120, and/or variations in electrical resistance of heaters 130) associated with individual nozzles 110 to obtain uniform print density on recorder medium 50 and "gray-scaling" at each dot or pixel and also reduces the potential for void formation in ink body 100. This result is attainable because controlling the voltage pulse amplitude and/or voltage pulse width controls the surface tension of ink droplet 150, which in turn controls the volume of ink released from each nozzle 110. Of course, controlling the volume of ink released from each nozzle 110 controls the print density and the amount of gray-scaling provided by each nozzle 110. In addition, controlling the delay interval between pulses controls the rate at which heat energy is supplied to ink body 100, so as to reduce the potential for void formation in ink body 100.

To ensure uniform print density, each nozzle 110 of a selected print head 45 is calibrated, such as by techniques disclosed in commonly assigned, copending U.S. patent application Ser. No. 08/826,353 (attorney docket no. 75069) titled "Imaging Apparatus And Method For Providing Images Of Uniform Print Density" filed Mar. 26, 1997, in the name of Xin Wen, the disclosure of which is hereby incorporated by reference. In this regard, a plurality of test images are produced with print head 45 to determine the print density (i.e., droplet volume) produced by each nozzle 110 given a predetermined voltage pulse amplitude and pulse width supplied to each of the heaters 130 associated with respective ones of the nozzles 110. This data is then stored in a memory unit or semiconductor chip 160, which is connected to controller 40 (see FIG. 1). Chip 160 may, for example, be a Read-Only-Memory (ROM) semiconductor computer chip. Controller 40 is informed by the values of pulse amplitude and pulse width stored in chip 160 as to the correct pulse amplitude and pulse width to apply to each nozzle 110 in order to obtain uniform print density among nozzles 110 and in order to obtain the desired gray-scale level at each dot or pixel of the output image.

By way of example only and not by way of limitation, representative embodiments of the multi-pulse inventive concept taught herein is provided hereinbelow.

Figure 8:
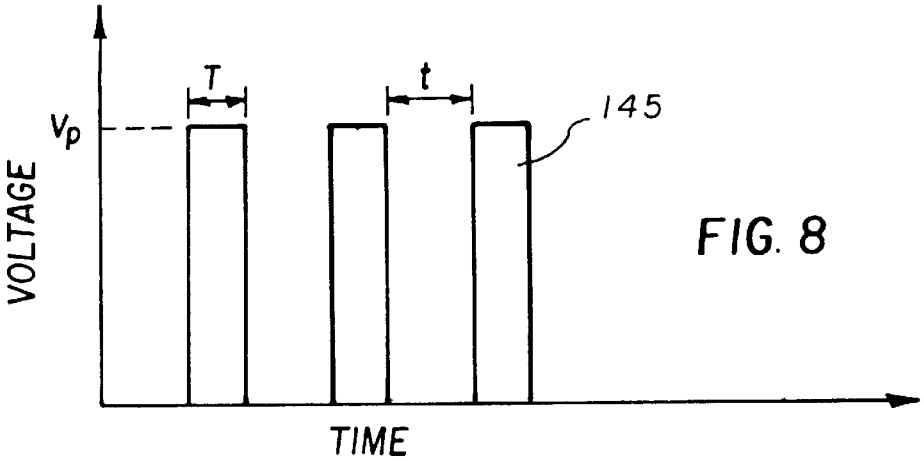
FIG. 8 is a graph illustrating voltage amplitude as a function of time, this graph also showing a plurality of voltage pulses having an identical pulse amplitude $V_p$ and an identical pulse width T, the voltage pulses being spaced-apart by a predetermined delay interval $\tau$.

FIG. 8 shows a plurality of voltage pulses supplied to a selected heater 130 for controlling droplet volume released from nozzle 110 associated with heater 130. Each of the pulses has an identical pulse amplitude $V_p$ and an identical pulse width T, the voltage pulses being spaced-apart by a predetermined delay interval τ. Each pulse belonging to these intermittent voltage pulses allows the heated ink droplet 150 to move out of the vicinity of heater 130 before the next pulse is supplied. This technique extends heating time and increases the volume of ink droplet 150. Moreover, this string of pulses also effectively merge separate droplets into one droplet to increase the density scale (i.e., gray-scale) at each dot or pixel of the output image. In addition, pulse amplitude $V_p$, pulse width T and delay interval τ are chosen so that the amount of heat energy supplied to ink 100 is never sufficient to induce bubbles or void formation in ink 100. In this regard, it is appreciated that it takes more time to supply a given amount of heat energy to ink 100 using the plurality of pulses shown in FIG. 8 than it takes to supply the same amount of heat energy to ink 100 using a single pulse. This is primarily due to the presence of delay interval τ and an otherwise reduced value of pulse amplitude $V_p$. Hence, boiling in ink 100 is precluded by use of the invention because heat energy supplied to ink 100 to sufficiently reduce the surface tension of droplet 150 occurs over a longer time than in the case of a single pulse. In other words, the rate of heat energy supplied to ink 100 is less using the plurality of pulses of FIG. 8 than with a single pulse. In addition, it should be understood from the teachings herein that delay interval τ need not be a constant value and, thus, may vary among the pulses.

Figure 9:
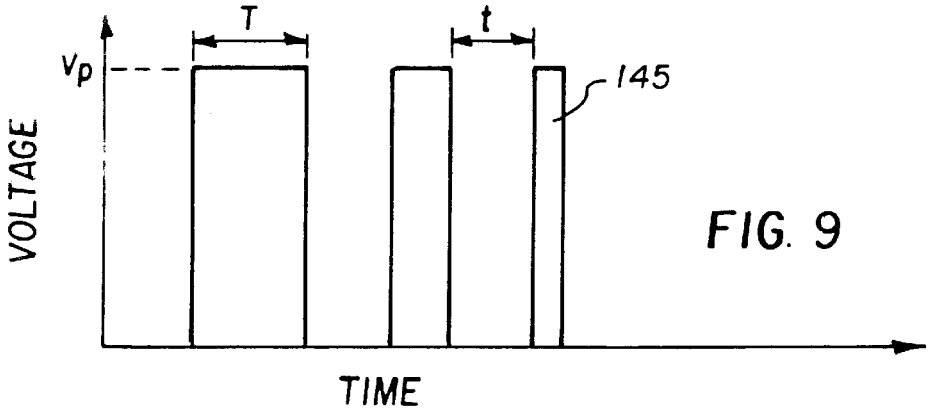
FIG. 9 is a graph illustrating voltage amplitude as a function of time, this graph also showing a plurality of voltage pulses having an identical pulse amplitude $V_p$ combined with pulse widths T decreasing with respect to time, the voltage pulses being spaced-apart by a predetermined delay interval $\tau$.

FIG. 9 shows a plurality of voltage pulses supplied to a selected heater 130 for controlling droplet volume released from nozzle 110 associated with heater 130. Each of the pulses has an identical pulse amplitude $V_p$ and pulse widths T decreasing with respect to time, the voltage pulses being spaced-apart by a predetermined delay interval τ. Again, pulse amplitude $V_p$, pulse width T and delay interval τ are chosen so that the amount of heat energy supplied to ink 100 is never sufficient to induce bubbles or void formation in ink 100. In addition, the pulse widths T shown in FIG. 9 are greater earlier during heat energy input to ink 100 in order to supply the maximum amount of heat energy subject to a constraint that boiling not be induced in ink 100. Moreover, the pulses are spaced-apart by delay interval τ to reduce the potential for boiling.

Figure 10:
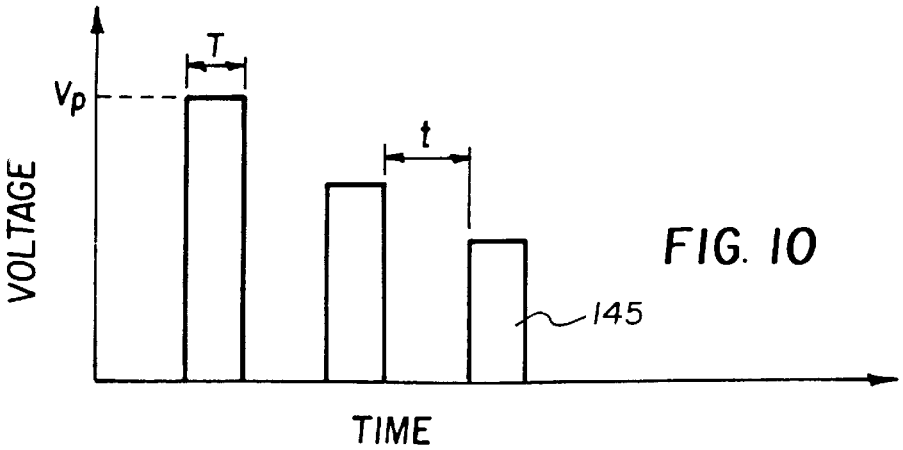
FIG. 10 is a graph illustrating voltage amplitude as a function of time, this graph also showing a plurality of voltage pulses having decreasing pulse amplitudes $V_p$ combined with an identical pulse width T, the voltage pulses being spaced-apart by a predetermined delay interval $\tau$.

FIG. 10 shows a plurality of voltage pulses supplied to a selected heater 130 for controlling droplet volume released from nozzle 110 associated with heater 130. The pulses have pulse amplitudes $V_p$ decreasing with respect to time and identical pulse widths T, the voltage pulses being spaced-apart by a predetermined delay interval τ. The pulse amplitudes $V_p$ shown in FIG. 10 are greater earlier during heat energy input to ink 100 in order to supply the maximum amount of heat energy subject to the constraint that boiling not be induced in ink 100. Moreover, the pulses are spaced-apart by delay interval τ to reduce the potential for boiling.

With respect to the representative embodiments of the multi-pulse inventive concept taught herein, it has been found that a correlation exists between pulse amplitude $V_p$, pulse width T, delay time τ, and potential for void formation. In this regard, formation of voids in the ink near heater 130 is a function of average power generated by heater 130. That is, the higher the average power, the higher the temperature of the ink in the vicinity of heater 130. When the temperature of the ink exceeds approximately 100° C., vapor bubbles (i.e., voids) will form in the ink. Thus, average power and propensity for void formation is related to pulse amplitude $V_p$, pulse width T, delay time τ by the following mathematical expression:

$$P_{ave}=E_{total}/T_{total} \tag{1}$$

where, $P_{ave}$≡average power of heater 130, $E_{total}$≡total energy applied to heater 130 and $T_{total}$≡total time of pulsing including pulse widths T and delay times τ.

Hence, it may be appreciated from the discussion hereinabove that, $$T_{total}\equiv T_1+\tau_1+T_2+\tau_2+T_3+\tau_3+\ldots T_i+\tau_i+\ldots T_n+\tau_n \tag{2}$$

where, $T_i \equiv$ pulse width for ith pulse $\tau_i \equiv$ delay time between ith pulse and i+1 pulse, and n=number of pulses where i=1 to n.

Also, it may be appreciated that the previously mentioned $E_{total}$ is defined by the following mathematical expression:

$$E_{total}=(V^2_{p1}\,T_1+V^2_{p2}\,T_2+V^2_{p3}\,T_3+\ldots\,V^2_{pi}\,T_i+\ldots\,V^2_{pn}\,T_n)/R \quad (3)$$

where, $V^2_{pi} \equiv$ voltage amplitude of ith pulse squared $R \equiv$ electrical resistance of heater 130 and $n \equiv$ number of pulses where i=1 to n.

Therefore, it can be seen that average power $P_{ave}$ and thus propensity for void formation increases with increased pulse amplitude $V_p$, decrease in delay time $\tau$ or decrease in electrical resistance R.

Figure 11:
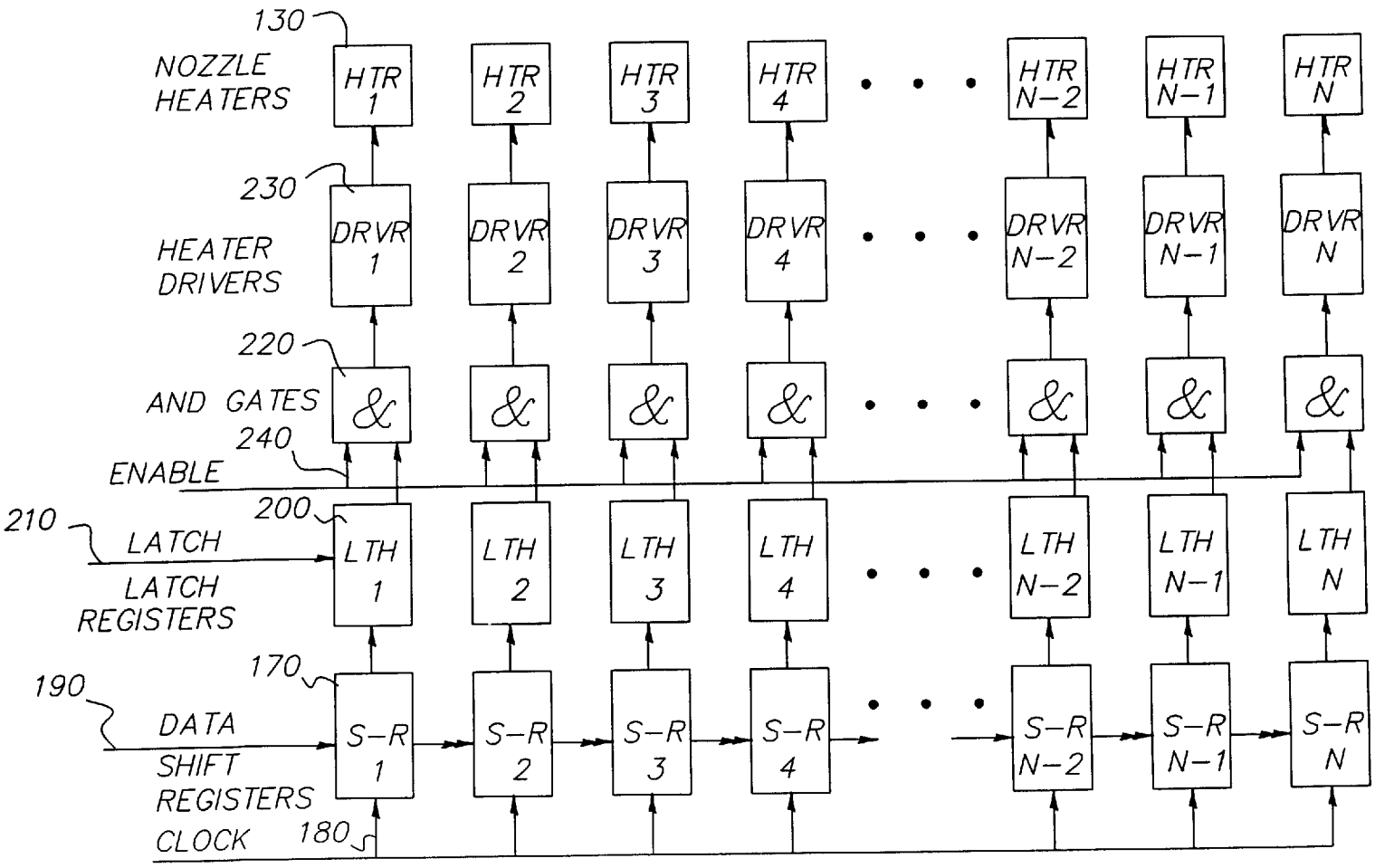
FIG. 11 is a functional block schematic of a serial shift register usuable with the invention.

Referring to FIGS. 11–15, operation of previously mentioned controller 40 will now be described. However, it should be appreciated that the description hereinbelow is exemplary only, because any one of many commercially available controllers can be used to practice the invention. Therefore, with respect to controller 40, nozzles 110 are configured as a serial shift register to minimize the number of electrical connections between controller 40 and printhead 45. As shown in FIG. 11, a 1-bit wide serial shift register 170 is N registers long, where N is the number of ink jet nozzles 110. A CLOCK input signal 180 is used to move a digital data value (1 or 0) present at a DATA input 190 through the shift register. The 1 bit of data is shifted for each clock pulse. With respect to the serial shift register 170, the contents of a register location "p" (not shown) is moved into register location "p+1" (also not shown) on the rising edge of clock signal 180. The contents of register location "p−1" is moved into location "p" on this same rising edge of the clock signal. Thus, to fill all N locations of the serial shift register with new data from the DATA input 190 requires N clock periods, each clock period having a rising and falling edge.

In addition, print head 45 contains a separate set of latch registers 200. Each of the N serial registers 170 has an associated latch register 200. Therefore there are N latch registers 200. The operation of latch registers 200 is controlled by a LATCH~input 210. During normal operation of print head 45, latch registers 200 hold a set of constant data values for nozzles 110 while a new set of data is being clocked into the serial shift register. When the serial shift register 170 has been filled with N new data values, LATCH~input 210 pulses low. The low pulse on the LATCH~input 210 transfers the contents of all N serial registers into their associated latch registers 210. The contents of latch registers 210 and their associated outputs remain constant until the next LATCH~input 210 pulse occurs.

As shown in FIG. 11, the output of each latch register 200 is connected to an associated digital AND gate 220. The output of each AND gate 220 is connected to an associated driver 230 which is used to apply power to previously mentioned heaters 130 respectively associated with each nozzle 110. Each driver 230 could be, for example, an open collector NPN transistor or an open drain N-channel power MOSFET device, which acts as an electrically controlled ON/OFF switch for nozzle heater 130. A second signal, which is an ENABLE input signal 240 flows to all of the AND gates 220. Thus, for an individual heater 130 to be energized, the following two conditions are true: (1) the contents of the associated latch register 200 is a digital 1; and (2) The ENABLE input signal 240 must be a digital 1. When both inputs to AND gate 220 are digital 1, the output of AND gate 220 will be a digital 1 and the associated driver will be turned ON and power will be applied to heater 130.

The use of the latch register output and the AND gate 220 to control the ON time for a heater is an important concept in implementation of PWM (Pulse Width Modulation). PWM is accomplished by using AND gate 220, where ENABLE signal 240 defines the maximum pulse width (PWmax), and the output of the associated latch register 200 controls the width of the pulse to the associated heater 130. The width of the pulse to each heater 130 is adjusted by controlling the data in the corresponding latch register 200, which is ultimately provided by the serial data from the DATA input 190 to print head 45.

Figures 12A, 12B, 12C:
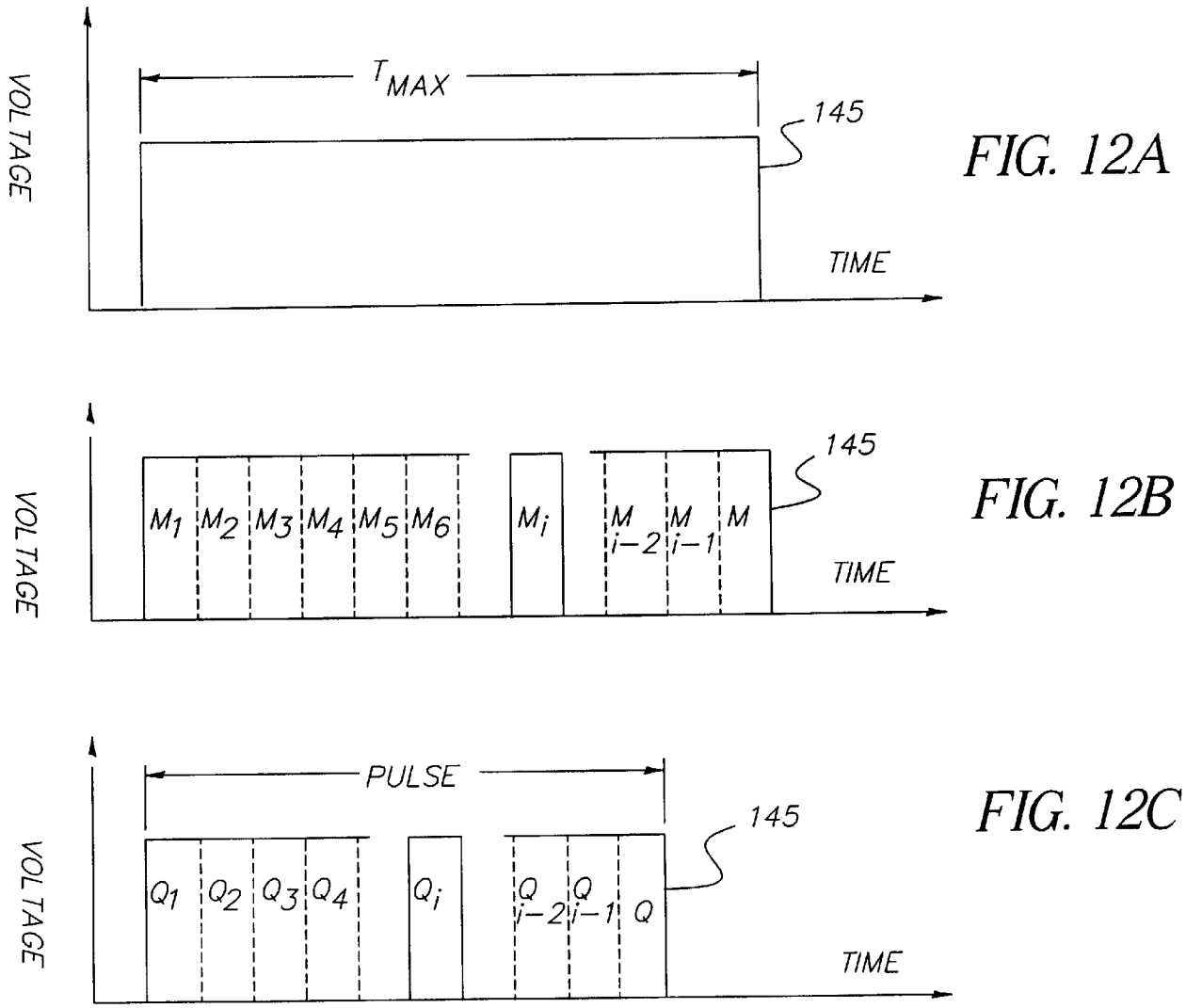
FIG. 12 illustrates pulse width modulation.

Referring to FIGS. 12A, 12B and 12C, previously mentioned pulse width "1" of one or more pulses 145 in a pulse sequence supplied to heater 130 is adjusted. FIG. 12A shows an ENABLE signal pulse, FIG. 12B shows maximum width heater pulse, and FIG. 12C shows pulse width modulated pulse at heater 130. For purposes of clarity, only one pulse 145 from the pulse sequence is shown. Of course, PWM can be applied to each pulse 145 in a pulse sequence. Heater pulse 145 actually consists of $M_i$ discrete time periods, where i=1 to M. Each of these $M_i$ discrete time periods is greater than or equal to the time required to fill and latch the N registers in serial shift register 170 (Period$\geqq$N*1/fclk+latch time). The data value shifted in the serial shift register 170 for this heater 130 would be a digital 1 for each time interval when the pulse was high and heater 130 ON. In the example, heater pulse 145 is pulsed ON for Q time periods. The data value shifted into serial shift register 170 for this heater 130 is 0 when pulse 145 must be brought low and heater 130 turned OFF. For each remaining time period of the M periods when the heater is OFF, the corresponding data value shifted into serial shift register 170 for this heater 130 is 0. Thus, the data value for this heater is 0 for M-Q time periods. Again, the ENABLE signal 240 only establishes the maximum length of time any heater 130 can be ON. The data shifted into serial shift register 170 controls the pulse width of each heater 130 because this data is latched into latch register 200 and the output of the latch register 200 is ANDed with the ENABLE signal 240.

Most computers store pictorial image data in a parallel word form (1 byte=8 bits). However, the serial shift register print head design requires data in serial form as mentioned hereinabove. Thus, the parallel image data must be converted to a serial bit stream. Of course, the process of converting the parallel data into a serial bit stream is commonly referred to in the art as "modulation". The most common method of converting parallel data to a serial bit stream uses repeated comparisons to a reference value which is incremented each time serial shift register 170 has been completely filled with new data. In general the comparison must be done Z-1 times, where Z is the possible number of states or gray levels. The following example illustrates this point. Assume shift register 170 is short, with only 5 registers, as shown in Table 1 below. Also assume the parallel words are only 3 bits wide (8 states). Each image data value in our example must be compared to the incrementing reference value 7 times.

TABLE 1

| Image Data And Equivalent Pulse Width | |
|---|---|
| Binary Image Data | Pulse Width |
| 101 | 5 |
| 001 | 1 |
| 111 | 7 |
| 010 | 2 |
| 000 | 0 |

The image data is sequentially compared to the first reference value, 000. If the image data value is greater than the reference value, a digital value of 1 is produced and clocked into the printhead serial shift register 170, as shown in Table 2 below.

TABLE 2

| Comparisons Of Image Data To First Reference Value | | |
|---|---|---|
| Binary Image Data | Reference Value | Comparison Result |
| 101 | 000 | 1 |
| 001 | 000 | 1 |
| 111 | 000 | 1 |
| 010 | 000 | 1 |
| 000 | 000 | 0 |

From these comparisons, the serial bit stream 11110 will be shifted into printhead serial shift register 170, where the left-most 1 is the first bit shifted into head 45, as shown in Table 2 above. The latch signal will occur, and the first ENABLE pulse 240 will be activated. The reference value will be incremented and the comparison process will be repeated.

TABLE 3

| Comparisons Of Image Data To Second Reference Value | | |
|---|---|---|
| Binary Image Data | Reference Value | Comparison Result |
| 101 | 001 | 1 |
| 001 | 001 | 0 |
| 111 | 001 | 1 |
| 010 | 001 | 1 |
| 000 | 001 | 0 |

From the comparisons shown in Table 3, the serial bit stream 10110 will be shifted into the printhead serial shift register 170, where the left-most 1 is the first bit shifted into print head 45. The latch signal will occur, and the second ENABLE pulse 240 will be activated. The reference value will be incremented and the comparison process will be repeated. A summary of all the comparisons is provided in Table 4 below.

TABLE 4

| Summary of Comparisons | | | | | | | | |
|---|---|---|---|---|---|---|---|---|
| Binary | Reference Values | | | | | | | |
| Image Data | 000 | 001 | 010 | 011 | 100 | 101 | 110 | Pulse Width |
| | Comparison Results | | | | | | | |
| 101 | 1 | 1 | 1 | 1 | 1 | 0 | 0 | 5 |
| 001 | 1 | 0 | 0 | 0 | 0 | 0 | 0 | 1 |

TABLE 4-continued

| Summary of Comparisons | | | | | | | | |
|---|---|---|---|---|---|---|---|---|
| Binary | Reference Values | | | | | | | |
| Image Data | 000 | 001 | 010 | 011 | 100 | 101 | 110 | Pulse Width |
| | Comparison Results | | | | | | | |
| 111 | 1 | 1 | 1 | 1 | 1 | 1 | 1 | 7 |
| 010 | 1 | 1 | 0 | 0 | 0 | 0 | 0 | 2 |
| 000 | 0 | 0 | 0 | 0 | 0 | 0 | 0 | 0 |

Each process of comparing all the image data values to one reference value corresponds to the time period required to load the print head serial shift register with one set of 5 comparison results listed in one of the result columns shown in Table 4. The 7 sets of 5 comparison values correspond to the 35 data values that are serially shifted into print head 45 to modulate the parallel image data into a serial bit stream.

Figure 13:
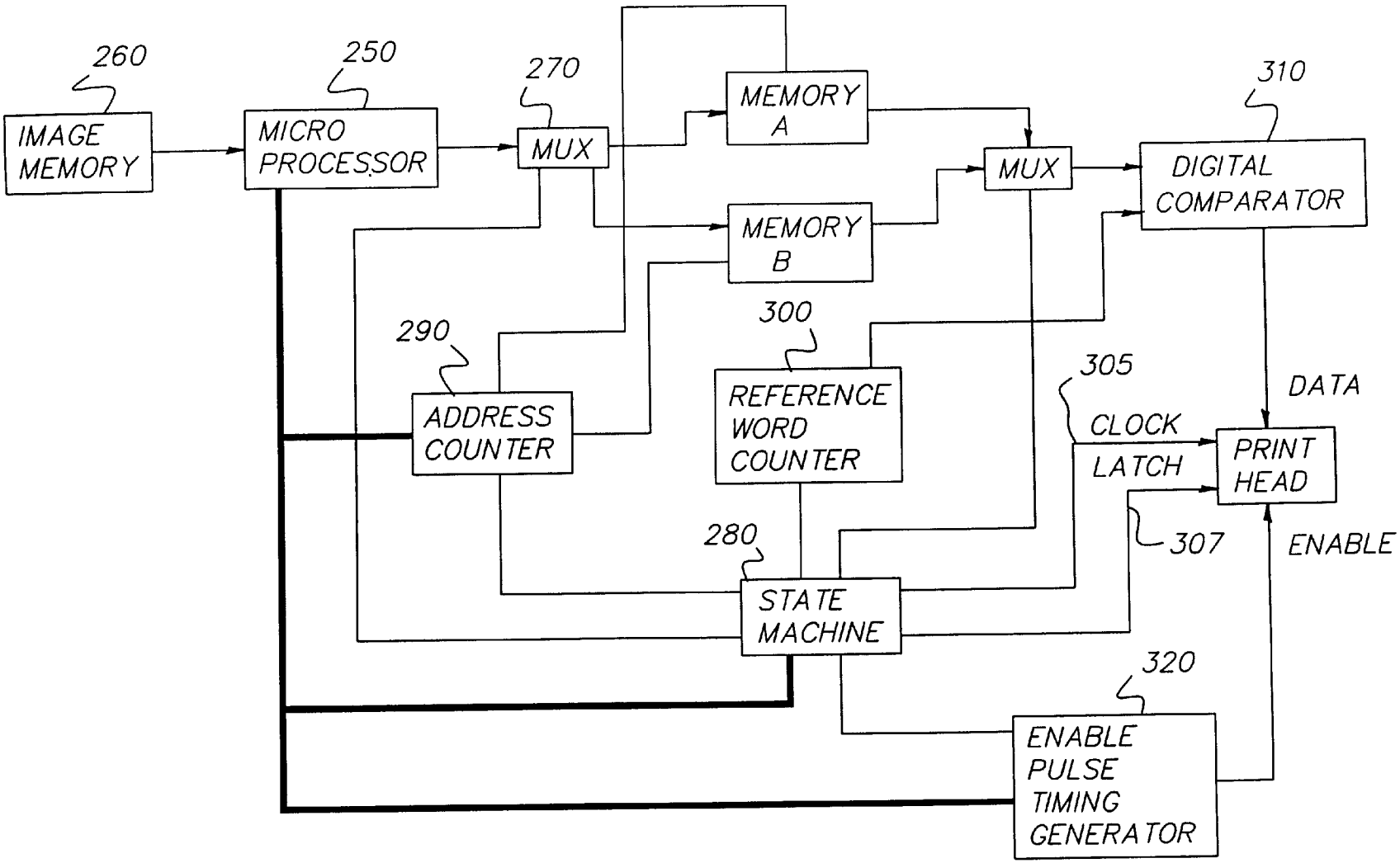
FIG. 13 illustrates another embodiment of pulse width modulation.

FIG. 13 shows a Pulse Width Modulator (i.e., controller 40) for ink jet print head 45. The system shown in FIG. 13 can be used to control pulse width T, delay time $\tau$, and pulse amplitude $V_p$. The system shown in FIG. 13 uses a general purpose microprocessor 250 to control the overall performance of the system. The data corresponding to the image is initially stored in Image Memory 260. The image data being modulated is repeatedly accessed to do the multiple comparisons necessary for modulation. Because the multiple memory accesses are time sensitive and should not be interrupted, the modulator has exclusive use of the image data and corresponding memory locations during the modulation process. To meet these requirements a "ping-pong" memory design is used where the modulator has direct access to either of two sections of memory, Memory A, or Memory B. Initially, microprocessor 250 loads Memory A through the input multiplexer 270 with a section of image data to be modulated. When Memory A is full of image data, microprocessor 250 begins to fill Memory B with image data. While the microprocessor is filling Memory B, a State Machine 280 will initiate the modulation process on the image data stored in Memory A. State Machine 280 is a logical sequence execution device that can be custom designed by a person of ordinary skill in the art for fast execution and repetitive tasks. State Machine 280 provides the logical sequence of incrementing an address counter 290 to address each image data location in the memory during the modulation process. State Machine 280 also increments a Reference Word Generator 300, as required during the comparison process. Reference Word Generator 300 may be an up counter. State Machine 280 provides a CLOCK signal 305 to print head 45 when the DATA output from a Digital Comparator 310 is stable. State Machine 280 also provides a LATCH signal 307 when print head shift register 170 has been filled with a complete set of new serial data from Digital Comparator 310. State Machine 280 also initiates an ENABLE Pulse Timing Generator 320 at the correct time. Enable Pulse Timing Generator 320, as configured by microprocessor 250, establishes a maximum heater pulse width $T_{max}$ (see FIG. 12A) via ENABLE signal 240 to print head 45. Thus, State Machine 280 has uninterrupted access to the image data stored in Memory A and completes the modulation process without interruption from microprocessor 250. Normally, when State Machine 280 has completed the modulation of the image data in Memory A, the microprocessor will have completed the loading of image data into Memory B. The State Machine will toggle the input and output multiplexers and State Machine 280 will begin modulating the image data in Memory B while the microprocessor begins loading a new set of image data into Memory A. When the Memory B image data has been modulated, State Machine 280 will return to Memory A to modulate a new set of image data loaded by microprocessor 250. This process of toggling or ping-ponging between the two sets of memory during the modulation process is from where the previously mentioned "ping-pong" memory design terminology was derived.

Figure 14:
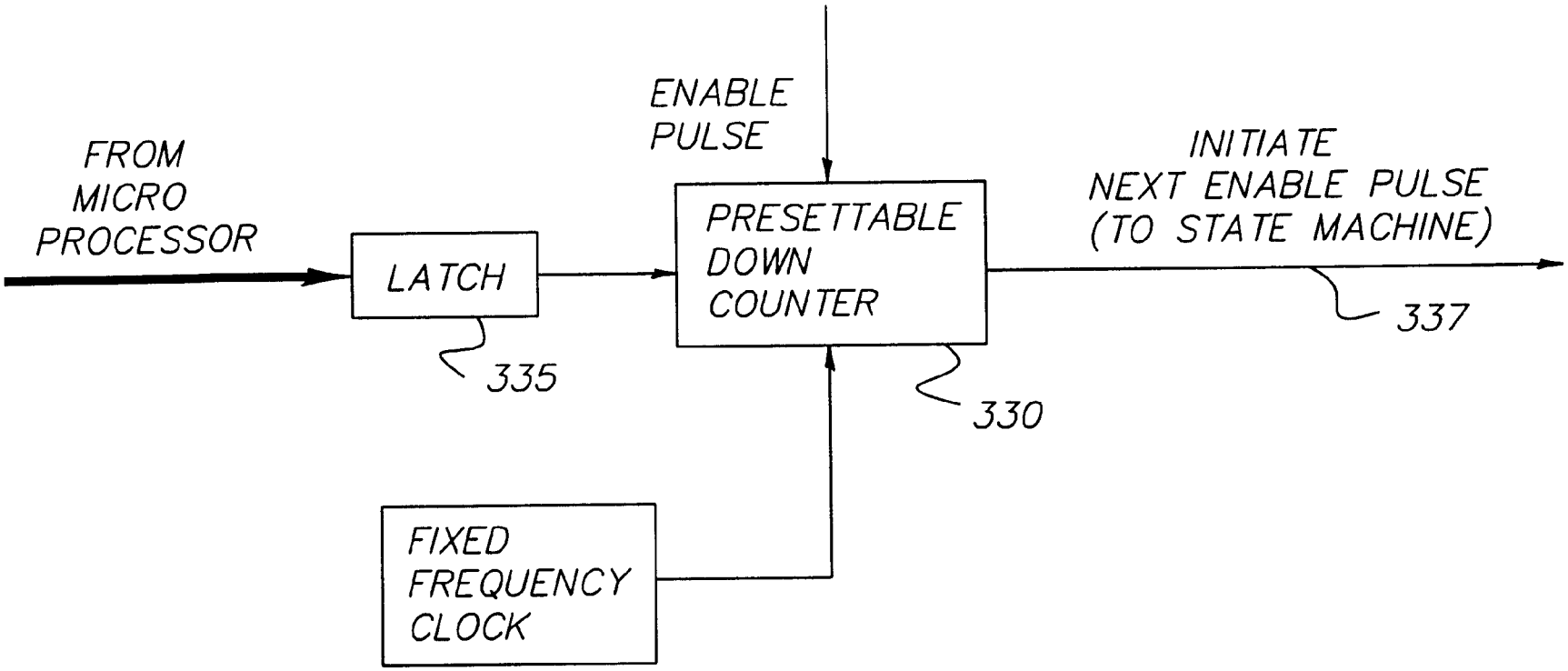
FIG. 14 is a functional block schematic of a technique for timing generator for delay between heater pulses.

FIG. 14 shows a design to control the delay interval $\tau$ between heater enable pulses 145. Microprocessor 250 (see FIG. 13) stores a preset for a presettable down counter 330 associated with input latch 335. Down counter 330 is preset with the count stored in latch 335 by microprocessor 250 and incremented by a fixed frequency clock until zero is reached. When the counter reaches zero, a signal is generated which initiates the generation of the next ENABLE pulse 240 by sending an Initiate signal 337 to State Machine 280 shown in FIG. 13. State Machine 280 begins the loading of new data into serial shift register 170 of print head 45 for the next heater pulse 145 in the sequence. Because a serial shift register print head is the example disclosed herein, the value chosen for $\tau$ is common for all heaters in print head 45, since all heaters are modulated concurrently in the serial shift register head. The value of $\tau$ can be changed easily by changing the preset value loaded by microprocessor 250 in latch 335, since this value ultimately presets the down counter 330 at the end of each ENABLE pulse 240, before it begins the down counting to zero to determine $\tau$. However, in a print head design with relatively small number of nozzles 110, each nozzle 110 could be driven directly, rather than via a shift register, and independent presettable down counters could be included for each nozzle. Thus, each nozzle 110 could have a separate and independent time interval $\tau$ between heater enable pulses.

Figure 15:
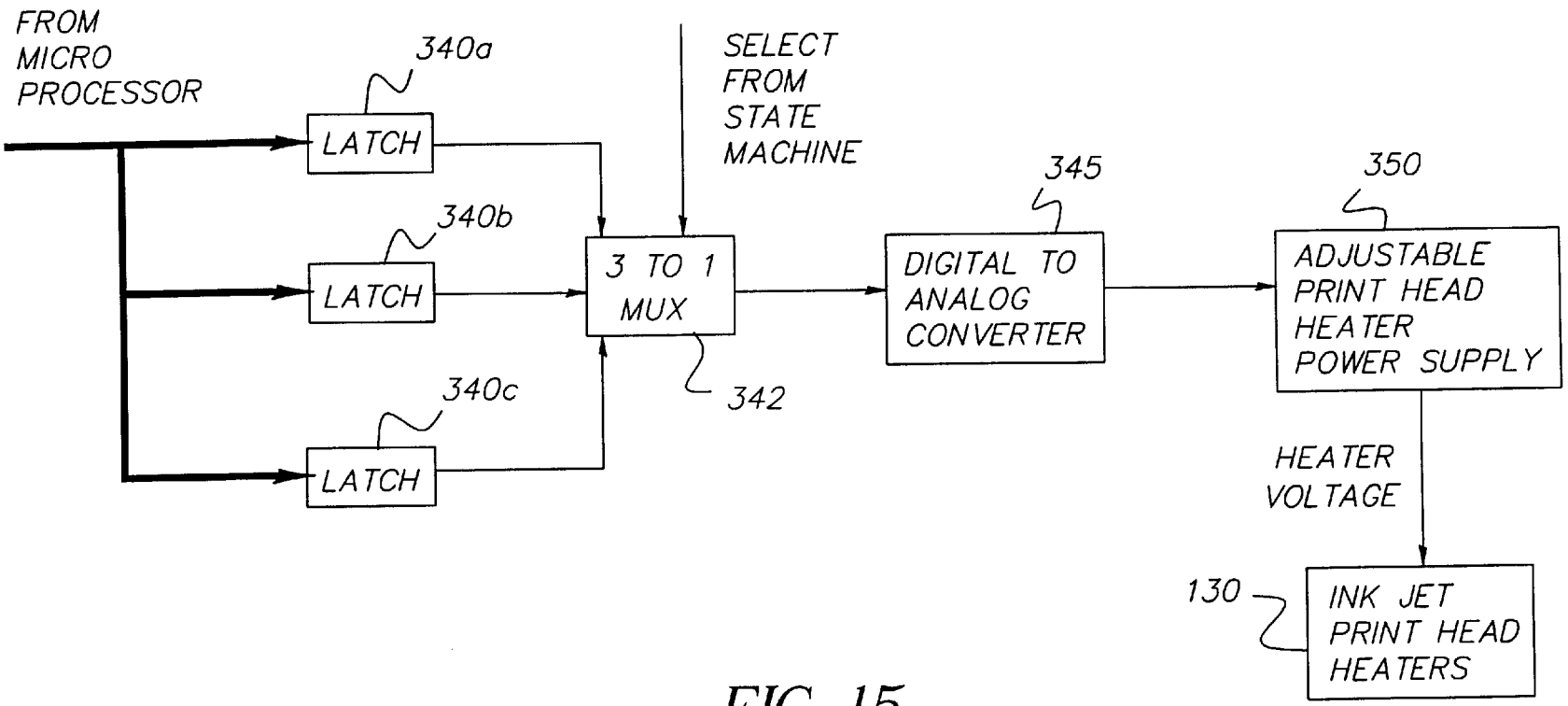
FIG. 15 is a functional block schematic of a technique for voltage amplitude control.

FIG. 15 shows a method to control the pulse amplitude or voltage applied to heater 130 during each pulse 145. Microprocessor 250, from FIG. 13, loads three latches 340a/b/c (one for each ENABLE pulse) with a digital value corresponding to the desired voltage required during pulse 145. A digital MUX 342 (Multiplexer) allows one of the 3 values to be applied to a DAC (Digital-to-Analog Converter), referred to as 345. The output of the DAC is applied to the input of an adjustable power supply 350 which provides voltage to heaters 130. The analog output from DAC 345 controls the voltage present on the output of power supply 350. Thus, the digital value selected by the 3 to 1 MUX controls the voltage amplitude at heaters 130, and effectively the corresponding amplitude $V_p$ of heater pulse 145. The MUX address lines are controlled by State Machine 280 which increments the address for each new ENABLE pulse 240. For the serial shift register print head design disclosed herein, nozzles 110 for one color are preferably all connected to one voltage source. It is also possible to use an independent power supply (not shown) for each color print head and duplicate the system shown in FIG. 15 for each set of nozzles 110 dedicated to one color. In a print head design with relatively small number of nozzles 110, each nozzle 110 could be driven directly, rather than via a shift register, and independently adjustable voltage sources, as shown in FIG. 15, could be included for each nozzle 110. Thus, each nozzle 110 could have separate and independent pulse amplitudes $V_p$.

By way of example, the previously mentioned elements comprising controller 40 may, for example, be assembled from the following commercially available components:

1. Microprocessor: Intel Pentium
2. Input and Output MUXes for ping-pong memory: IDT74FCT162260ETPV
3. Memory Address Counter: Altera programmable logic EPM7256SQC208-7
4. Memory A and Memory B: Cypress CYM1861-25
5. Digital Comparator, Enable Timing, & Delay Counter: Altera programmable logic EPF10K10_208
6. State Machine: Altera programmable logic EPF10K20_208
7. Digital to Analog Converter: AD7226KR (4 voltage outputs available)
8. Power Supply: Custom design.

It is appreciated from the teachings herein, that an advantage of the present invention is that images of uniform print density are provided even in the presence of variations in physical attributes such as electrical resistance of the heaters 130 and/or diameter of the nozzle orifices 120. This is so because each nozzle 110 is calibrated to compensate for such variability among nozzles 110. This eliminates visual printing defects, such as "banding".

A further advantage of the present invention is that each nozzle 110 is capable of obtaining gray-scale printing simultaneously with obtaining uniform print density because the volume of ink released by each nozzle 110 is controlled.

Yet another advantage of the present invention is that the potential for void formation in the ink is reduced. This is so because an otherwise single voltage pulse is partitioned into a plurality of spaced-apart pulses in order to avoid excessive heating of the ink.

While the invention has been described with particular reference to a several preferred embodiments, it will be understood by those skilled in the art that various changes may be made and equivalents may be substituted for elements of the preferred embodiment without departing from the spirit and scope of the invention. In addition, many modifications may be made to adapt a particular situation and material to a teaching of the present invention without departing from the essential teachings of the invention. For example, the invention is described as supplying any one of the wave forms separately illustrated in FIGS. 8 through 10. However, the wave forms illustrated in each of the FIGS. 8 through 10 are representative only. That is, any combination of voltage amplitude $V_p$, pulse width T and delay interval $\tau$ may be chosen such that the rate of heat energy input to ink 100 is maximized subject to the constraint that boiling not be induced in ink 100.

Therefore, what is provided is an imaging apparatus and method for providing images of uniform print density, so that printing non-uniformities, such as banding, are avoided, so that gray-scaling can be achieved at each dot or pixel of the output image, and so that the potential for void formation is reduced.

The invention has been described in detail with particular reference to certain preferred embodiments thereof, but it will be understood that variations and modifications can be effected within the spirit and scope of the invention.

PARTS LIST

10 imaging apparatus
20 printer
30 input source
40 controller
50 recorder medium
60 rollers
70 supply tray

80 output tray
90 ink fluid cavities
100 body of ink
110 nozzle
120 orifice
130 heater
140 voltage supply unit
145 pulse
150 ink droplet
160 memory unit/computer chip
170 shift registers
180 CLOCK input signal
190 DATA input
200 latch registers
210 LATCH input
220 AND gate
230 heater driver
240 ENABLE input signal
250 microprocessor
260 image memory
270 multiplexer
280 State Machine
290 address counter
300 reference word generator
305 CLOCK signal
307 LATCH signal
310 digital comparator
320 ENABLE pulse timing generator
330 presettable down counter
335 latch
337 initiate signal
340a/b/c latches
342 3 to 1 MUX (Multiplexer)
345 digital to analogue converter
350 adjustable power supply

What is claimed is:

1. An imaging apparatus, comprising:

(a) a nozzle for ejecting print fluid therefrom, the print fluid having a volume defined by heat energy supplied to the print fluid and having a potential for void formation;

(b) a heater adapted to be in heat transfer communication with the print fluid for supplying the heat energy to the print fluid; and (c) a controller connected to said heater for variably controlling a plurality of voltage pulses supplied to said heater from a voltage supply unit in order to variably control the heat energy supplied by said heater, each voltage pulse having a predetermined pulse amplitude and a predetermined pulse width, adjacent ones of the pulses being spaced-apart in time by a predetermined delay interval, whereby the volume of the print fluid ejected from said nozzle is variably controlled as said controller variably controls pulse amplitude, pulse width and delay time to control the heat energy and whereby void formation in the print fluid is avoided as said controller variably controls the pulse amplitude, pulse width and delay time to control the heat energy.

2. The imaging apparatus of claim 1, wherein said controller variably controls each voltage pulse so that each voltage pulse has a predetermined pulse amplitude and a predetermined pulse width.

3. The imaging apparatus of claim 1, wherein said controller variably controls each voltage pulse so that adjacent ones of the pulses are spaced-apart in time by a predetermined delay interval.

4. An imaging apparatus adapted to control ink droplet volume and void formation, comprising:

(a) a nozzle for ejecting an ink droplet therefrom, the ink droplet having a volume defined by heat energy supplied to the ink droplet and having a potential for void formation;

(b) a heater element adapted to be in heat transfer communication with the ink droplet for supplying the heat energy to the ink droplet; and (c) a controller connected to said heater element for variably controlling the heat energy supplied by said heater element, said controller variably controlling the heat energy by variably controlling a plurality of voltage pulses sequentially supplied to said heater element from a voltage supply unit, each of the voltage pulses having a predetermined pulse amplitude, a predetermined pulse width and a predetermined time interval between pulses variably controlled by said controller, whereby the volume of the ink droplet ejected from said nozzle is variably controlled as said controller variably controls the pulse amplitude, pulse width and time delay and whereby void formation in the ink droplet is avoided as said controller variably controls the pulse amplitude, pulse width, and delay time.

5. The imaging apparatus of claim 4, wherein said controller variably controls each voltage pulse so that the pulses are spaced-apart in time by a predetermined delay interval.

6. The imaging apparatus of claim 4, wherein said controller variably controls the pulse amplitude and the pulse width of each pulse so that the pulses have an identical pulse amplitude and an identical pulse width.

7. The imaging apparatus of claim 4, wherein said controller variably controls the pulse amplitude and the pulse width of each pulse so as to define a first pulse followed in time by a second pulse having an identical pulse amplitude as the pulse amplitude of the first pulse and a pulse width less than the pulse width of the first pulse, the first pulse and the second pulse being spaced-apart in time by a predetermined delay interval.

8. The imaging apparatus of claim 4, wherein said controller variably controls the pulse amplitude and the pulse width of each pulse so as to define a first pulse followed in time by a second pulse having an identical pulse width as the pulse width of the first pulse and a pulse amplitude less than the pulse amplitude of the first pulse, the first pulse and the second pulse being spaced-apart in time by a predetermined delay interval.

9. The imaging apparatus of claim 4, further comprising a memory unit connected to said controller for storing data including fluid volume as a function of a predetermined control parameter.

10. The imaging apparatus of claim 4, further comprising a memory unit connected to said controller for storing data including print density as a function of a predetermined control parameter.

11. An ink-jet printer adapted to control ink droplet volume deposited on a recorder medium disposed in the printer and adapted to avoid void formation in the ink droplet, the printer comprising:

(a) a plurality of nozzles, each nozzle having a generally circular orifice for ejecting an ink droplet therefrom of a predetermined volume defined by heat energy supplied to the droplet, the orifice being disposed proximate the recorder medium for exit of the droplet through the orifice and onto the recorder medium;

(b) a plurality of generally annular heater elements surrounding respective ones of the orifices, each of said heater elements adapted to be in heat transfer communication with a respective one of the ink droplets for supplying the heat energy to the ink droplet; and (c) a controller electrically connected to said heater elements for variably controlling the heat energy supplied by said heater elements, said controller variably controlling the heat energy by variably controlling a plurality of voltage pulses sequentially supplied to each heater element from a voltage supply unit so as to define a first pulse having a first predetermined pulse amplitude and a first predetermined pulse width, the first pulse delayed in time from a second pulse having a second predetermined pulse amplitude and a second predetermined pulse width, whereby the delay time, the first pulse amplitude and first pulse width and the second pulse amplitude and second pulse width supplied to each heater element are variably controlled as said controller variably controls the first and second pulses, whereby the heat energy supplied to each heater element is variably controlled as said controller variably controls the first pulse amplitude and first pulse width and the second pulse amplitude and second pulse width, whereby the volume of the droplet ejected from the orifice of each heater element is variably controlled as the heat energy supplied to each heater element is variably controlled, and whereby void formation in the droplet is avoided as said controller variably controls the heat energy.

12. The imaging apparatus of claim 11, wherein said controller variably controls each voltage pulse so that adjacent voltage pulses are spaced-apart in time by a predetermined delay interval.

13. The imaging apparatus of claim 11, (a) wherein the first pulse amplitude and the second pulse amplitude are identical; and (b) wherein the first pulse width and the second pulse width are identical, the first pulse width and the second pulse width being spaced-apart by a delay interval.

14. The imaging apparatus of claim 11, (a) wherein the first pulse amplitude and the second pulse amplitude are identical; and (b) wherein the second pulse width is less than the first pulse width, the first pulse width and the second pulse width being spaced-apart by a delay interval.

15. The imaging apparatus of claim 11, (a) wherein the second pulse amplitude is less than the first pulse amplitude; and (b) wherein the first pulse width and the second pulse width are identical, the first pulse width and the second pulse width being spaced-apart by a delay interval.

16. The imaging apparatus of claim 11, further comprising a memory unit connected to said controller for storing data including fluid volume as a function of a predetermined control parameter.

17. The imaging apparatus of claim 16, wherein said memory unit is a read-only memory unit.

18. The imaging apparatus of claim 11, further comprising a memory unit connected to said controller for storing data including print density as a function of a predetermined control parameter.

19. The imaging apparatus of claim 18, wherein said memory unit is a read-only memory unit.

20. An imaging method, comprising the steps of:

(a) providing a nozzle adapted to eject a print fluid therefrom, the print fluid having a volume defined by heat energy supplied to the print fluid and having a potential for void formation;

(b) providing a heater adapted to be in heat transfer communication with the print fluid for supplying the heat energy supplied to the print fluid; and (c) providing a controller adapted to variably control a plurality of voltage pulses supplied to the heater from a voltage supply unit in order to variably control the heat energy supplied by the heater, including the steps of: (i) providing each voltage pulse with a predetermined pulse amplitude and a predetermined pulse width, adjacent ones of the pulses being spaced-apart in time by a predetermined delay interval; (ii) variably controlling the pulse amplitude, pulse width or delay interval so that the volume of the print fluid ejected from the nozzle is variably controlled as the pulse amplitude, pulse width and delay time are variably controlled to control the heat energy; and (iii) avoiding void formation in the print fluid as the controller variably controls the pulse amplitude, pulse width and delay time to control the heat energy.

21. The imaging method of claim 20, wherein said step of variably controlling the heat energy supplied by the heater comprises the step of providing a controller connected to the heater, the controller being capable of variably controlling each voltage pulse so that each voltage pulse has a predetermined pulse amplitude and a predetermined pulse width.

22. The imaging method of claim 20, wherein said step of variably controlling the heat energy supplied by the heater comprises the step of providing a controller connected to the heater, the controller being capable of variably controlling each voltage pulse so that adjacent ones of the pulses are spaced-apart in time by a predetermined delay interval.

23. The imaging method of claim 20, wherein said step of variably controlling the heat energy supplied by the heater comprises the step of providing a memory unit connected to the controller for storing data including fluid volume as a function of a predetermined control parameter.

24. The imaging method of claim 20, wherein said step of variably controlling the heat energy supplied by the heater comprises the step of providing a memory unit connected to the controller for storing data including print density as a function of a predetermined control parameter.

25. For use in an ink-jet printer, an imaging method of controlling ink droplet volume and void formation, comprising the steps of:

(a) providing a nozzle adapted to eject an ink droplet therefrom, the ink droplet having a volume defined by heat energy supplied to the ink droplet and having a potential for void formation;

(b) providing a heater element adapted to be in heat transfer communication with the ink droplet for supplying the heat energy to the ink droplet;

(c) providing a controller adapted to variably control a plurality of voltage pulses supplied to the heater from a voltage supply unit in order to variably control the heat energy supplied by the heater element by variably controlling a plurality of voltage pulses sequentially supplied to the heater element, including the steps of: (i) providing each of the voltage pulses with a predetermined pulse amplitude and a predetermined pulse width, adjacent ones of the pulses being spaced-apart in time by a predetermined delay interval; (ii) variably controlling the pulse amplitude, pulse width or delay interval so that the volume of the ink droplet ejected from the nozzle is variably controlled as the controller variably controls the pulse amplitude, pulse width an delay time to control the heat energy; and (iii) avoiding void formation in the ink droplet as the controller variably controls the pulse amplitude, pulse width and delay interval to control the heat energy.

26. The imaging method of claim 25, wherein said step of variably controlling the heat energy supplied by the heater element comprises the step of providing a controller connected to the heater element, the controller being capable of variably controlling each voltage pulse so as to predetermine the pulse amplitude and the pulse width.

27. The imaging method of claim 25, wherein said step of variably controlling the heat energy supplied by the heater element comprises the step of providing a controller connected to the heater element, the controller being capable of variably controlling each voltage pulse so that adjacent ones of the pulses are spaced-apart in time by a predetermined delay interval.

28. The imaging method of claim 25, wherein said step of variably controlling the heat energy supplied by the heater element comprises the step of providing a controller connected to the heater element, the controller being capable of variably controlling the pulse amplitude and the pulse width so that the pulses have an identical pulse amplitude and an identical pulse width, adjacent ones of the pulses being spaced-apart in time by a predetermined delay interval.

29. The imaging method of claim 25, wherein said step of variably controlling the heat energy supplied by the heater element comprises the step of providing a controller connected to the heater element, the controller being capable of variably controlling the pulse amplitude and the pulse width so as to define a first pulse followed in time by a second pulse having an identical pulse amplitude as the pulse amplitude of the first pulse and a pulse width less than the pulse width of the first pulse, the first pulse and the second pulse being spaced-apart in time by a predetermined delay interval.

30. The imaging method of claim 25, wherein said step of variably controlling the heat energy supplied by the heater element comprises the step of providing a controller connected to the heater element, the controller being capable of variably controlling the pulse amplitude and the pulse width so as to define a first pulse followed in time by a second pulse having an identical pulse width as the pulse width of the first pulse and a pulse amplitude less than the pulse amplitude of the first pulse, the first pulse and the second pulse being spaced-apart in time by a predetermined delay interval.

31. The imaging method of claim 25, wherein said step of variably controlling the heat energy supplied by the heater element comprises the step of providing a memory unit connected to the controller for storing data including fluid volume as a function of a predetermined control parameter.

32. The imaging method of claim 31, wherein said step of providing a memory unit comprises the step of providing a read-only memory unit.

33. The imaging method of claim 25, wherein said step of variably controlling the heat energy supplied by the heater element comprises the step of providing a memory unit connected to the controller for storing data including print density as a function of a predetermined control parameter.

34. The imaging method of claim 33, wherein said step of providing a memory unit comprises the step of providing a read-only memory unit.

* * * * *